US006954600B2

(12) United States Patent
Fujita et al.

(10) Patent No.: US 6,954,600 B2
(45) Date of Patent: Oct. 11, 2005

(54) ELECTRIC CONTACT MEMBER APPLYING VOLTAGE TO CHARGER, PROCESS CARTRIDGE, AND IMAGE FORMING APPARATUS

(75) Inventors: Akiyoshi Fujita, Shizuoka-ken (JP); Atsushi Numagami, Kanagawa-ken (JP); Takahito Ueno, Shizuoka-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 50 days.

(21) Appl. No.: 10/671,520

(22) Filed: Sep. 29, 2003

(65) Prior Publication Data

US 2005/0041992 A1 Feb. 24, 2005

(30) Foreign Application Priority Data

Sep. 30, 2002 (JP) ..... 2002-285107

(51) Int. Cl.[7] ..... G03G 15/00; G03G 21/00

(52) U.S. Cl. ..... 399/89; 361/225; 399/90; 399/129; 399/175

(58) Field of Search ..... 399/88, 89, 90, 399/36, 37, 149, 150, 129, 128, 174, 175, 176, 168, 343; 361/221, 225

(56) References Cited

U.S. PATENT DOCUMENTS 4,371,252 A * 2/1983 Uchida et al. ..... 399/175
5,283,616 A 2/1994 Numagami et al. ..... 399/111
5,383,011 A 1/1995 Numagami et al. ..... 399/358
5,500,714 A 3/1996 Yashiro et al. ..... 399/111
5,543,898 A 8/1996 Shishido et al. ..... 399/111
5,585,895 A 12/1996 Yashiro et al. ..... 399/103
5,617,579 A 4/1997 Yashiro et al. ..... 399/114
5,630,199 A * 5/1997 To ..... 399/175
5,689,774 A 11/1997 Shishido et al. ..... 399/111
5,768,658 A 6/1998 Watanabe et al. ..... 399/11

(Continued)

FOREIGN PATENT DOCUMENTS

GB 2 129 372 A * 5/1984
JP 06-051609 A * 2/1994
JP 09-043939 A * 2/1997
JP 2001-215799 8/2001

*Primary Examiner*—Sophia S. Chen
(74) *Attorney, Agent, or Firm*—Fitzpatrick, Cella, Harper & Scinto

(57) ABSTRACT

The present invention relates to an electric contact member applying a voltage from a voltage applying device to a charger reciprocally moving in a longitudinal direction of an image carrier. The member includes a securing portion electrically connected to a side of the voltage applying device, a moving portion reciprocally movable and connected electrically to a side of the charger, and a buffer portion formed between the securing portion and the moving portion.

28 Claims, 10 Drawing Sheets

U.S. PATENT DOCUMENTS 5,790,923 A 8/1998 Oguma et al. ..... 399/106
5,852,758 A * 12/1998 Wibbels ..... 399/176
5,920,753 A 7/1999 Sasaki et al. ..... 399/111
5,937,239 A 8/1999 Watanabe et al. ..... 399/111
5,937,242 A 8/1999 Yokoyama et al. ..... 399/114
5,963,759 A 10/1999 Kojima et al. ..... 399/111
5,966,566 A 10/1999 Odagawa et al. ..... 399/109
5,966,568 A 10/1999 Numagami et al. ..... 399/111
6,006,058 A 12/1999 Watanabe et al. ..... 399/167
6,016,413 A 1/2000 Yokoyama et al. ..... 399/113
6,029,032 A 2/2000 Watanabe et al. ..... 399/111
6,097,908 A 8/2000 Uchiyama et al. ..... 399/111
6,097,909 A 8/2000 Watanabe et al. ..... 399/111
6,101,354 A 8/2000 Nakagawa et al. ..... 399/225
6,118,960 A 9/2000 Nakagawa et al. ..... 399/111
6,131,007 A 10/2000 Yamaguchi et al. ..... 399/256
6,169,866 B1 1/2001 Watanabe et al. ..... 399/111
6,236,821 B1 5/2001 Yokoyama et al. ..... 399/113
6,246,848 B1 6/2001 Morinaga et al. ..... 399/106
6,246,849 B1 6/2001 Yokoyama et al. ..... 399/117
6,266,500 B1 7/2001 Numagami et al. ..... 399/104
6,272,299 B1 8/2001 Numagami et al. ..... 399/111
6,289,189 B1 9/2001 Numagami et al. ..... 399/111
6,324,370 B1 11/2001 Isobe et al. ..... 399/258
6,330,409 B1 12/2001 Watanabe et al. ..... 399/111
6,385,416 B1 5/2002 Horikawa et al. ..... 399/111
6,442,359 B1 8/2002 Numagami et al. ..... 399/111
6,463,233 B2 10/2002 Kojima et al. ..... 399/111
6,577,831 B1 6/2003 Numagami et al. ..... 399/111
6,608,980 B2 8/2003 Murayama et al. ..... 399/111
6,775,498 B2 * 8/2004 Palumbo et al. ..... 399/176
2002/0057924 A1 5/2002 Ueno et al. ..... 399/117
2002/0057928 A1 5/2002 Yasumoto et al. ..... 399/167
2002/0085854 A1 7/2002 Numagami et al. ..... 399/90
2002/0141788 A1 10/2002 Matsuda et al. ..... 399/260
2003/0049036 A1 3/2003 Ueno et al. ..... 399/25
2003/0049049 A1 * 3/2003 Hoshi et al. ..... 399/129
2003/0133723 A1 7/2003 Fujita et al. ..... 399/111
2004/0120729 A1 * 6/2004 Uyama et al. ..... 399/129

* cited by examiner

ELECTRIC CONTACT MEMBER APPLYING VOLTAGE TO CHARGER, PROCESS CARTRIDGE, AND IMAGE FORMING APPARATUS

BACKGROUND OF THE INVENTION

1. Field of the Invention

This invention relates to an image forming apparatus such as, e.g., electrophotographic copier, and electrophotographic printer, to a process cartridge detachably attached to the image forming apparatus body, and to an electric contact member suitable to be used in those apparatuses.

Herein, the image forming apparatus is to form images on recording media using electrophotographic image forming process. The image forming apparatus includes, e.g., electrophotographic copier, electrophotographic printer (LED printer, laser beam printer, etc.), electrophotographic facsimile machine, and electrophotographic word processor.

The process cartridge is made of a cartridge integrating an electrophotographic photosensitive drum as an image carrier with at least one of charging means, developing means, and cleaning means, and the cartridge is used as detachably attached to the image forming apparatus body.

2. Description of Related Art

Image forming apparatuses such as photocopiers, printers, and facsimile machines using an transfer type electrophotographic method are conventionally constituted of a photosensitive body as an image carrier typically made in a rotary drum shape, a charging device (charging process) for processing uniformly charging the photosensitive body at a prescribed polarity and potential, an exposing device (exposing process) as information writing means forming electrophotographic latent images on the photosensitive body processed with charging, a developing device (developing process) for visualizing the electrophotographic latent images formed on the photosensitive body with a developing agent, a transferring device (transferring process) for transferring the developing agent images onto a transfer material such as a paper from the surface of the photosensitive body, a cleaning device (cleaning process) cleaning the photosensitive body surface by removing the developing agent remaining more or less on the photosensitive body after the transfer process, and a fixing device (fixing process) for fixing the developing agent image on the transfer material, and the photosensitive body serves for image formation upon applying repeatedly the electrophotographic process (charging, exposing, developing, transferring, cleaning, and fixing).

Although the developing agent remaining on the photosensitive body after the transfer process is removed from the surface of the photosensitive body by the cleaning device and is reserved in the cleaning device as the waste developing agent, it is desirable to nullify such a waste developing agent in terms of environment preservation and effective use of resources. An image forming apparatus returning the remaining developing agent image, or namely so-called-the waste developing agent collected at the cleaning device and reutilizing the agent, has been known.

An image forming apparatus of non-cleaner type has been proposed in which the remaining developing agent image on the photosensitive body after the transfer process is removed by cleaning concurrently done with the development in the developing device and is collected to be reused. A structure, inter alia, has been proposed in which a developing agent charging amount controlling means is used as a charger (developing agent charging means) in the image forming apparatus as to control the charging amount of the developing agent to collect the developing agent at the developing device and reuse the agent.

However, in the image forming apparatus using the developing agent charging amount controlling means as the prior art, where an immobilized blush shape member is used as the developing agent charging amount controlling means and where the triboelectricity of the remaining developing agent image is controlled to be a proper charging amount with a normal polarity, overcharging of the remaining developing agent image may occur locally. If such overcharging of the remaining developing agent image occurs, the mirror reflection force between the photosensitive body and the overcharged developing agent becomes too strong, so that the remaining developing agent image cannot be attached even with a contact charging device, cannot be collected with the developing apparatus, and cannot be transferred with a transferring device, and consequently, the remaining developing agent image is adhered to the surface of the photosensitive body, thereby forming defective images.

It turns out that this phenomenon is caused by an immobilized brush serving as the developing agent charging amount controlling means being positioned continuously at a fixed location on the photosensitive body. That is, where the developing agent charging amount controlling means operates with irregular resistance, overcharging or inadequate charging always occurs at the same location on the photosensitive body. At the charged portion, the problems of localized overcharging or melting of the remaining developing agent image may occur. At the inadequate charging portion, the contact charging member may get dirty due to attachment of the developing agent because the remaining developing agent image cannot be charged adequately.

According to various recent needs of users, the above problems are further raised because a large remaining developing agent image occurs as a result of a continuous printing operation of high printing rate images, such as photographic images or multiple developing methods on the photosensitive body in association with rendering the images in multiple colors.

As a similar case, particles such as dust, floating developing agents, and charged products may attached onto a roller surface after a long period of use because the charging roller used as a charger for the photosensitive body rotates in contact with the photosensitive body. It is to be noted that Japanese Patent Application Publication 2001-215,799 discloses that a developing agent charging amount controlling means as the charger is moved reciprocally in the longitudinal direction of the photosensitive body, but a proper electric contact member is sought to apply a stable voltage to the developing agent charging amount controlling means moving reciprocally.

SUMMARY OF THE INVENTION

It is an object of the invention to provide an electric contact member stably applying voltage to a charger moving reciprocally, a process cartridge, and an image forming apparatus.

It is another object of the invention to provide an electric contact member, a process cartridge, and an image forming apparatus, not suffering from charging defects or image defects.

It is yet another object of the invention to provide an electric contact member, a process cartridge, and an image forming apparatus so that a charger can feed a proper charge amount to the remaining developing agent on an image carrier.

It is still another object of the invention to provide an electric contact member, a process cartridge, and an image forming apparatus preventing developing agent collection defect from occurring out of an image carrier or preventing the charging means from getting dirty upon attachments of the developing agent, caused by an improper charge amount of the remaining developing agent on the image carrier.

It is still further object of the invention to provide a process cartridge and an image forming apparatus utilizing an advantage from a non-cleaner system.

DETAILED DESCRIPTION OF THE PREFERRED EMBODIMENTS

Now, embodiments of an electric contact member, a process cartridge, and an image forming apparatus, according to the invention are described. In the description below, the term "longitudinal direction" is a direction perpendicular to the conveyance direction of the recording medium and is the same direction to the axial direction of the image carrier. The term "right and left" is the right and left direction when seen from the conveyance direction of the recording medium. The term "up and down" is the up and down direction when the cartridge is mounted.

[Description of the Whole Image Forming Apparatus]

Figure 1:
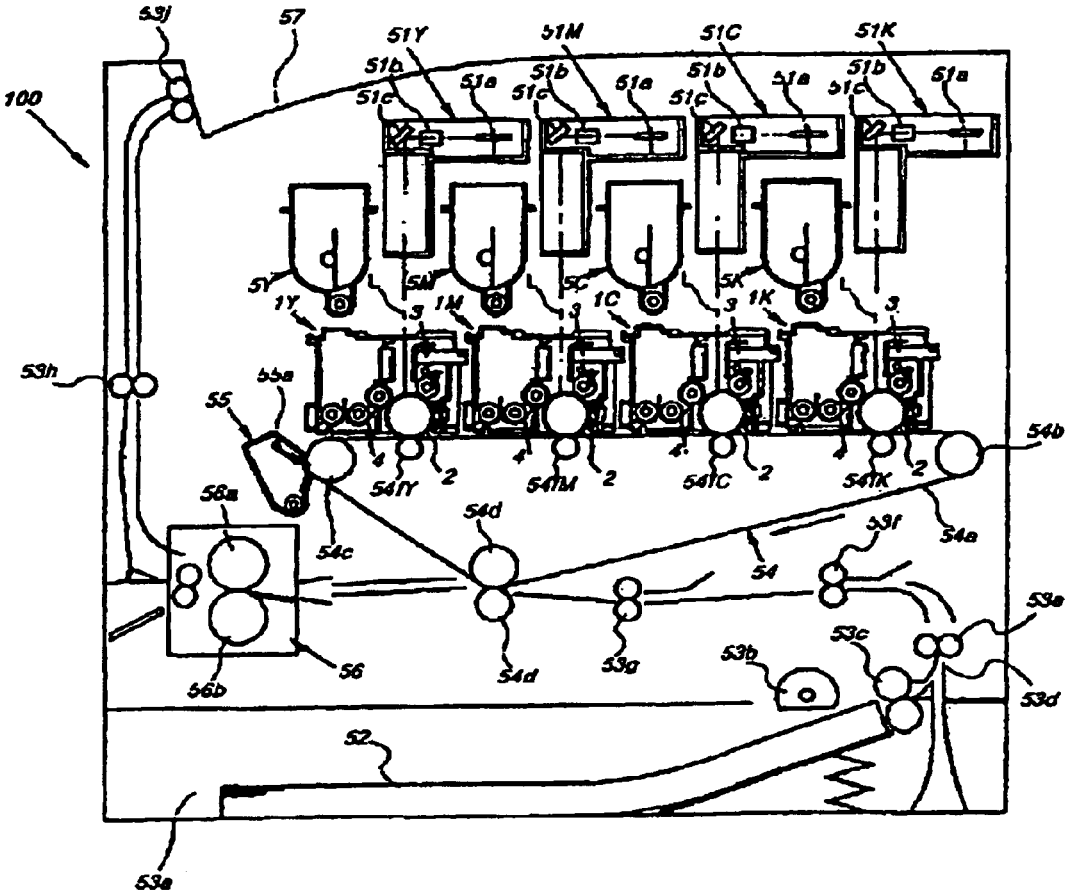
FIG. 1 is an illustration showing the whole structure of a laser beam printer as an embodiment of a multicolor electrophotographic image forming apparatus.

Referring to FIG. 1, the outline of the whole structure of the image forming apparatus is described. FIG. 1 is an illustration showing the whole structure of a laser beam printer as an embodiment of a multicolor electrophotographic image forming apparatus.

In the image forming portion of the multicolor laser beam printer, four process cartridges 1Y, 1M, 1C, 1K (yellow, magenta, cyan, black), each having a photosensitive drum (electrophotographic photosensitive body) 2 as an example of the image carrier, and exposing devices 51Y, 51M, 51C, 51K (laser beam optical scanning system) arranged above the process cartridges 1Y, 1M, 1C, 1K as corresponding to the respective colors are disposed parallel. A feeding device for feeding out a recording medium 52, an intermediate transfer unit 54 for transferring developing agent formed on the photosensitive drum 2, and a secondary transfer roller 54*d* for transferring the developing agent to the recording medium 52 from the intermediate transfer unit 54 are disposed below the image forming apparatus. A fixing device 56 for fixing the image on the recording medium 52 to which the developing agent image is transferred, and a delivering means for delivering the recording medium 52 out of the apparatus and for stacking the medium are also disposed. As the recording medium 52, exemplified are paper, OHP sheets, and fabrics.

The image forming apparatus of this embodiment is of an apparatus of non-cleaner system, and the remaining developing agent image remaining on the photosensitive drum 2 is reserved in the developing means, and no cleaner for collecting and reserving the remaining developing agent image is not disposed in the process cartridge.

[Feeding Section]

Structures of the respective sections of the image forming apparatus are described in detail sequentially. The feeding section is for feeding the recording medium 52 to the image forming section, and is constituted mainly of a feeding cassette 53*a* containing in a stacking manner the plural recording media 52, a feeding roller 53*b*, a retarding roller 53*c* for prevention of doubly feeding, a feeding guide 53*d*, a registration roller 53*g*. The feeding roller 53*b* is driven to rotate according to image forming operation and separately feeds the recording media 52 in the feeding cassette 53*a* sheet by sheet. The recording media 52 are guided by the feeding guide 53*d* and conveyed to the registration roller 53*g* via the conveyance rollers 53*e*, 53*f*.

The registration roller 53*g* stop rotating immediately after the recording medium 52 is conveyed, and any obliquely feeding of the recording medium 52 is corrected by the medium's hitting to the nipping portion. The registration roller 53*g* does, as a prescribed sequence, operation of non-rotation in which the recording medium 52 is still and waited during the image formation operation and operation of rotation in which the recording medium 52 is conveyed toward the intermediate transfer belt 54*a*, thereby aligning the developing agent and the recording medium 52 during the transfer process as the subsequent process.

[Process Cartridge]

Figure 2:
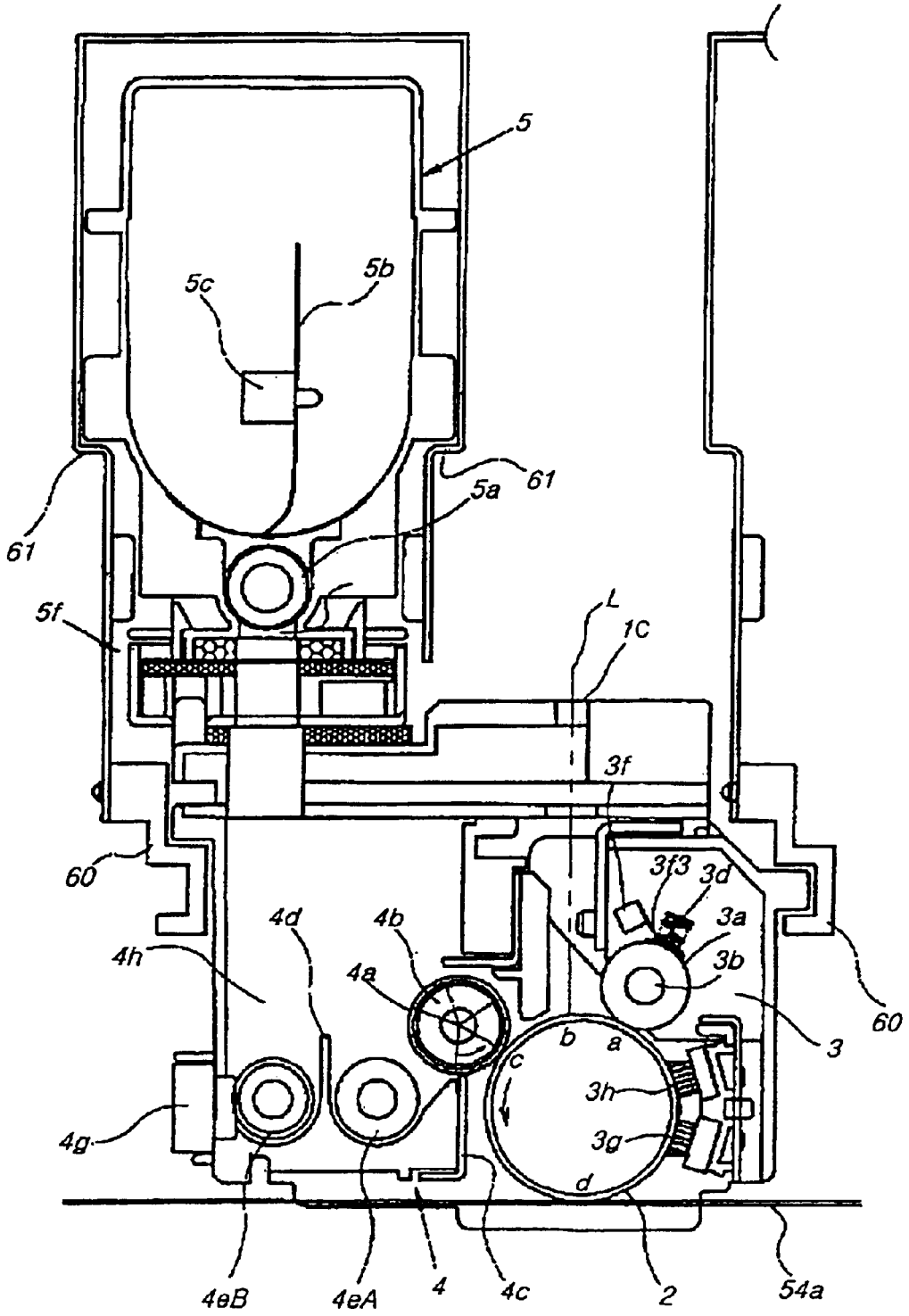
FIG. 2 is a cross section showing a process cartridge and a developing agent supplying container.
Figure 3:
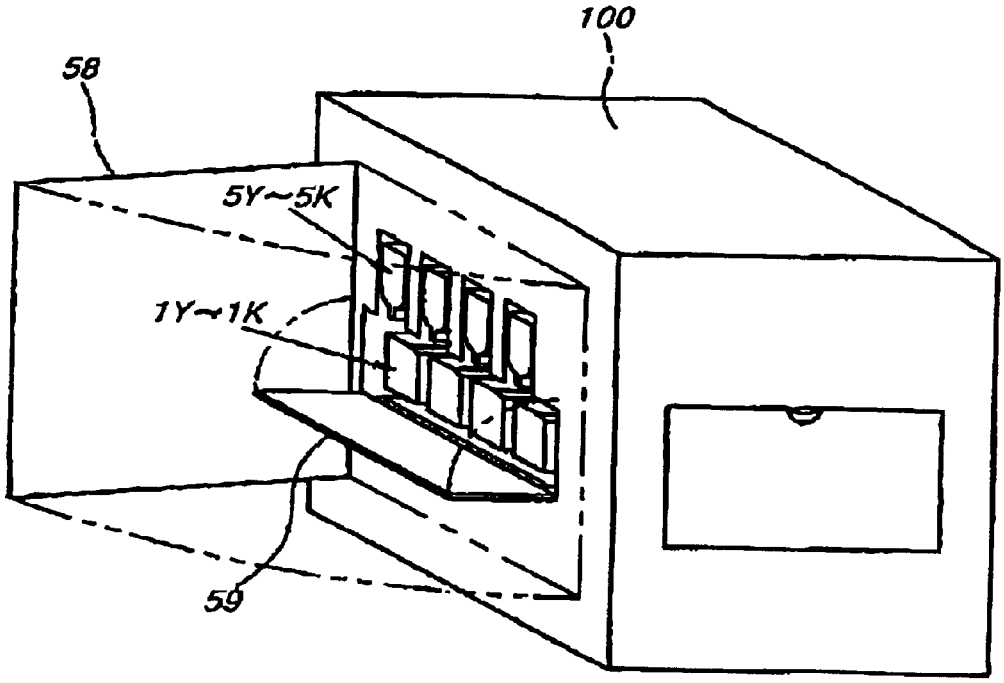
FIG. 3 is an appearance perspective view showing an image forming apparatus.
Figure 4:
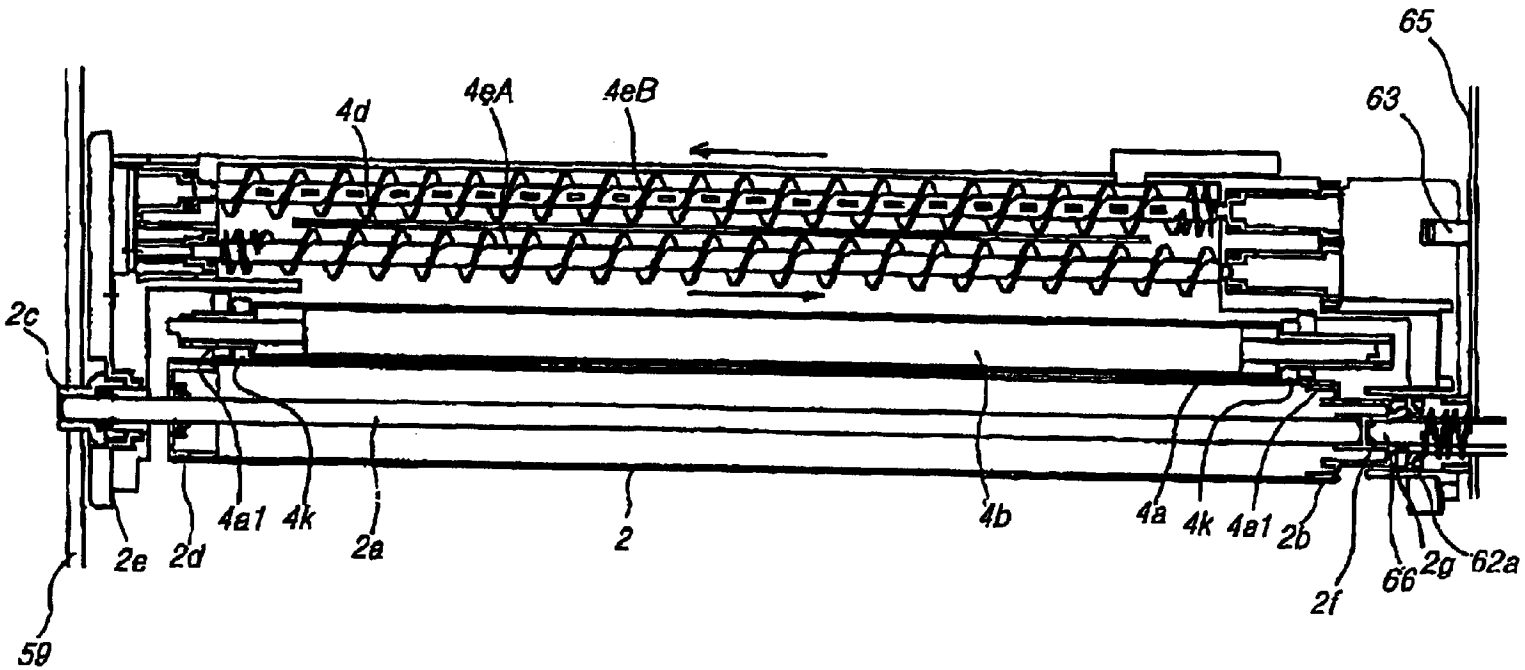
FIG. 4 is a cross section along a longitudinal direction showing a process cartridge.
Figure 5:
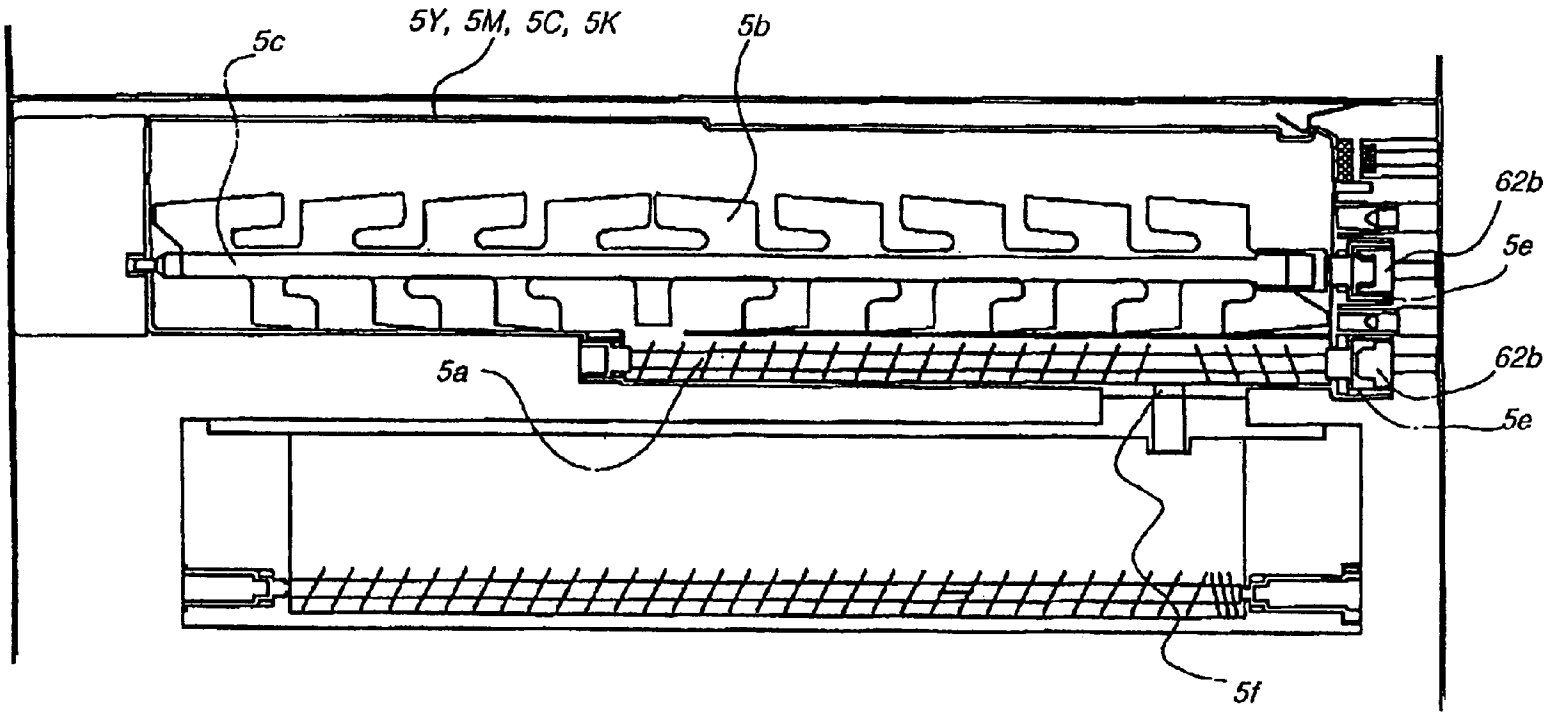
FIG. 5 is a cross section along a longitudinal direction showing a developing agent supplying container.

FIG. 2 is a cross section showing a process cartridge and a developing agent supplying container; FIG. 3 is an appearance perspective view showing an image forming apparatus; FIG. 4 is a cross section along a longitudinal direction showing a process cartridge; FIG. 5 is a cross section along a longitudinal direction showing a developing agent supplying container. In FIG. 2, a process cartridge 1C forming images in cyan is used as an example of the process cartridge 1.

Each of the process cartridges 1Y, 1M, 1C, 1K is constituted in a united body by arranging the charging means and the developing means around the photosensitive drum 2. The process cartridge can be detached easily by the user with respect to the apparatus body, and when the photosensitive drum 2 reaches the end of its life, the process cartridge is replaced. In this embodiment, e.g., where the rotation number of the photosensitive drum 2 is counted up and where the counted number exceeds the prescribed count number, it is determined that the process cartridge reaches the duration.

The photosensitive drum 2 of the embodiment is an organic photosensitive body negatively charged and has a photosensitive layer used generally on a drum base made of aluminum having a diameter of about 30 mm, and has an electric charge introduction layer at the topmost layer. The photosensitive drum 2 is driven to rotate at about 177 mm/sec as a prescribed process speed in this embodiment. The electronic charge introduction layer is made of a coated layer in which, e.g., SnO2 ultra fine particles are dispersed as conductive particles in an insulator resin binder.

As shown in FIG. 4, the drum flange 2*b* is secured to the rear side end of the photosensitive drum 2, and a non-drive flange 2*d* is secured to a front end. A drum shaft 2*a* penetrates the centers of the drum flange 2*b* and the non-drive flange 2*d*, and the drum shaft 2*a*, the drum flange 2*b*, and the non-drive flange 2*d* are rotated together. That is, the photosensitive drum 2 is rotated around the center of the shaft of the drum shaft 2*a*.

A front side end of the drum shaft 2*a* is rotatively supported to the bearing 2*e*, and the bearing 2*e* is immobilized to a bearing casing 2*c*. The bearing casing 2*c* is immobilized to a frame of the process cartridge.

[Charging Means]

Figure 6:
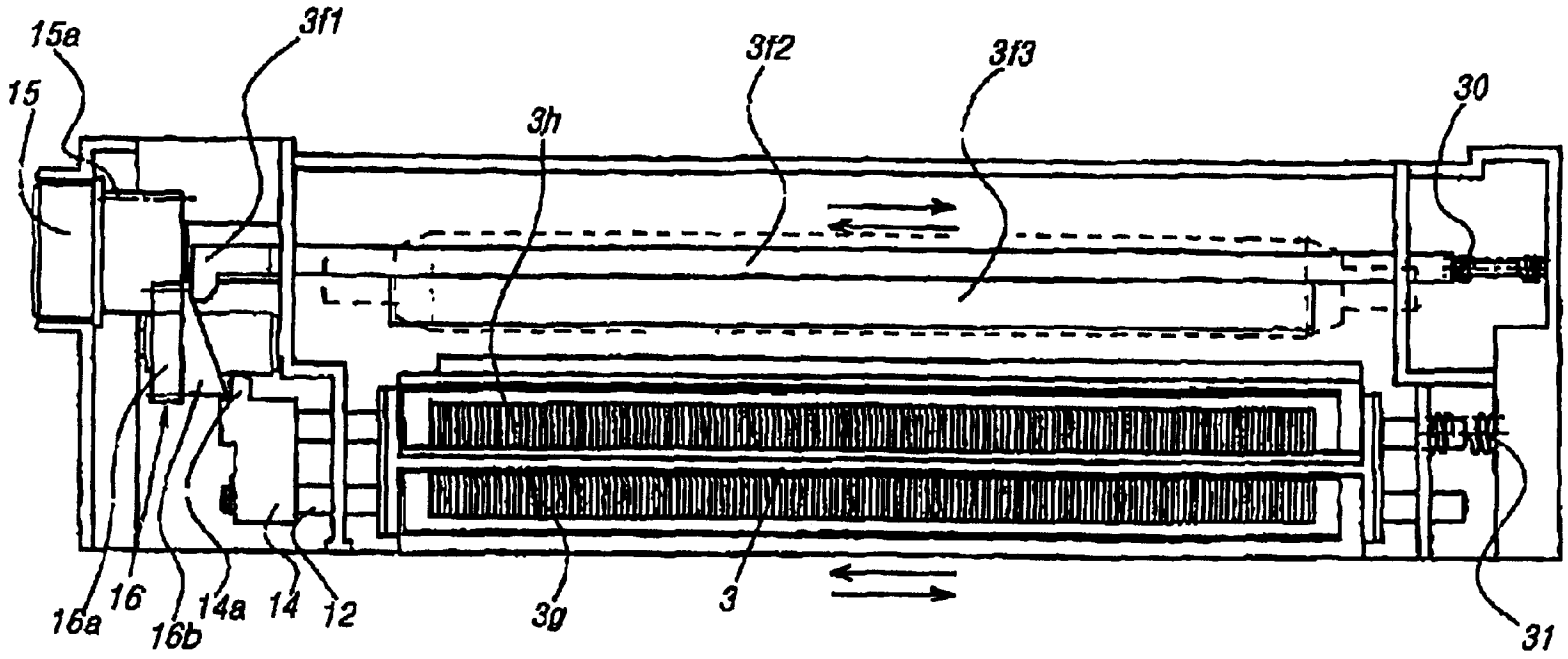
FIG. 6 is a diagram along a longitudinal direction showing a charging unit.

In this embodiment, the charging means is using a contact charging method, and uses, e.g., a charging roller 3*a* as a charging member 3*a*. FIG. 6 is a diagram along the longitudinal direction of the charging unit.

As shown in FIG. 2, the charging roller 3*a* holds the opposite ends of a metal core 3*b* as to be rotatable by bearings, not shown, and urges the ends by pushing springs 3*d* toward the photosensitive drum direction to contact with pressure the surface of the photosensitive drum 2 with a prescribed pushing force, thereby being driven to rotate by the rotation of the photosensitive drum 2.

A charging roller cleaning unit 3*f* near the charging roller 3*a* is provided. As shown in FIG. 6, the charging roller cleaning unit 3*f* has a flexible cleaning film 3*f*3. The flexible cleaning film 3*f*3 is disposed parallel in the longitudinal direction of the charging roller 3*a*; one end of the film is secured to a supporting member 3*f*2 moving reciprocally in a fixed amount with respect to the longitudinal direction of the charging roller 3*a*; the film is disposed as to form a contact nipping with the charging roller 3*a* at the surface around the free end side.

An arm portion 3*f*1 is formed at one end of the supporting member 3*f*2, and the arm portion 3*f*1 is in contact with a cam portion 16*b* of a cam gear unit 16 by being urged by a charging sheet returning spring 30 formed at the other end. Where rotational drive is transmitted to a coupling 15 by a drive means, not shown, from the exterior, the drive is transmitted from the coupling gear portion 15*a* to a cam gear 16*a* of the cam gear unit 16, thereby rotating the cam portion 16*b*. The surface of the cam portion 16*b* is inclined with respect to the rotary shaft, and the arm portion 3*f*1 moves along the surface when the cam portion 16*b* rotates, thereby converting the rotational drive to the reciprocal movement and rendering the supporting member 3*f*2 reciprocally movable in the longitudinal direction of the charging roller 3*a*. This causes the cleaning film 3*f*3 to rub the surface of charging roller 3*a*, thereby removing attachments (e.g., fine particle developing agent, additives) on the surface of the charging roller 3*a*.

[Non-Cleaner System]

Figure 7:
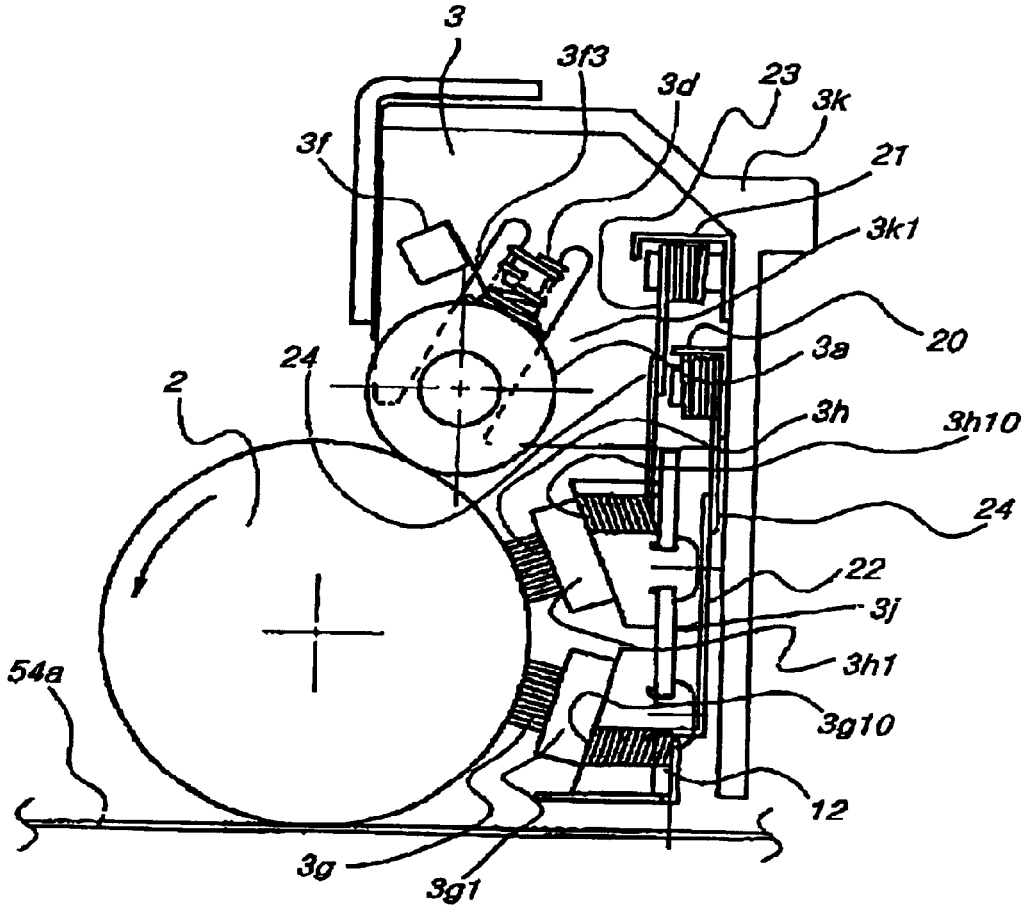
FIG. 7 is a cross section showing the charging unit adapting a non-cleaner system.
Figure 8:
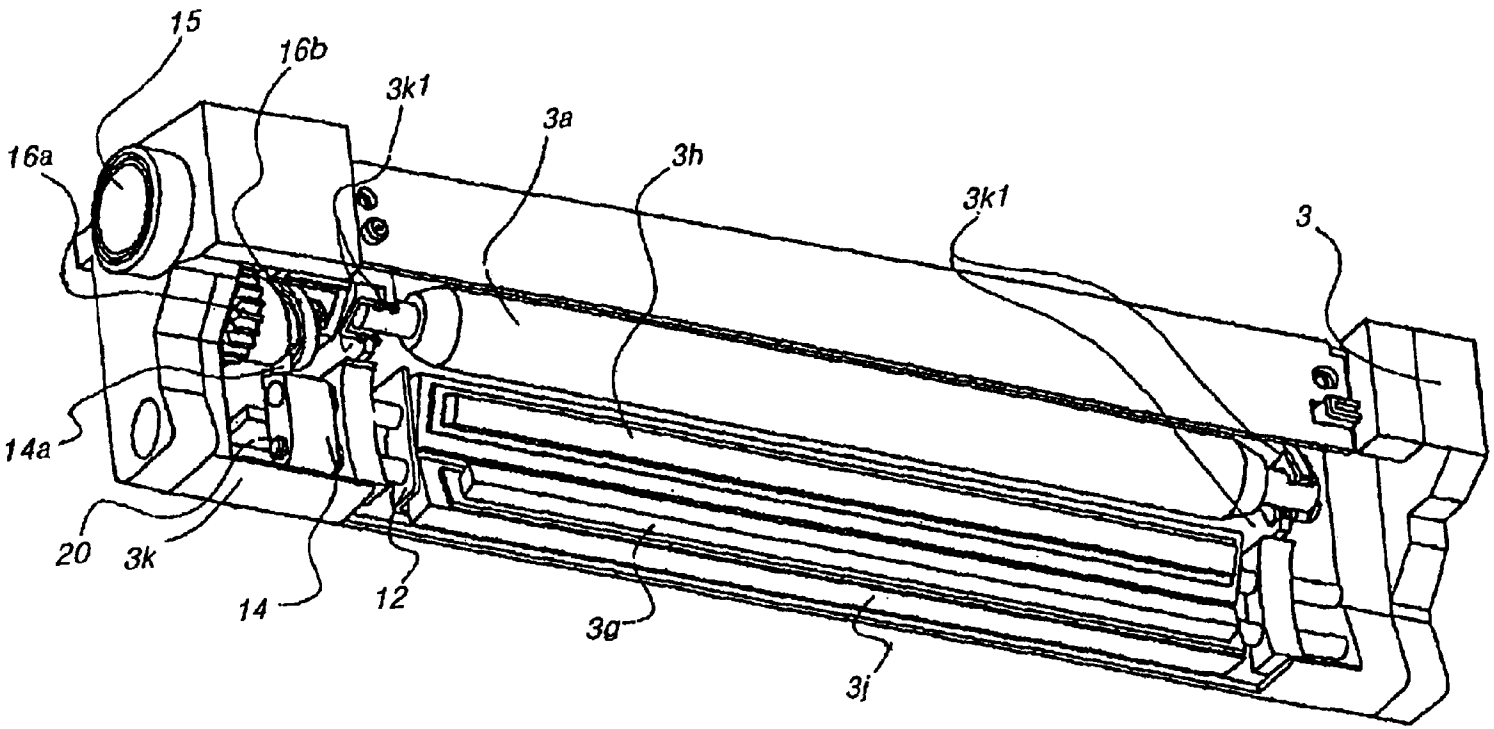
FIG. 8 is a perspective view showing the charging unit adapting the non-cleaner system.
Figure 9:
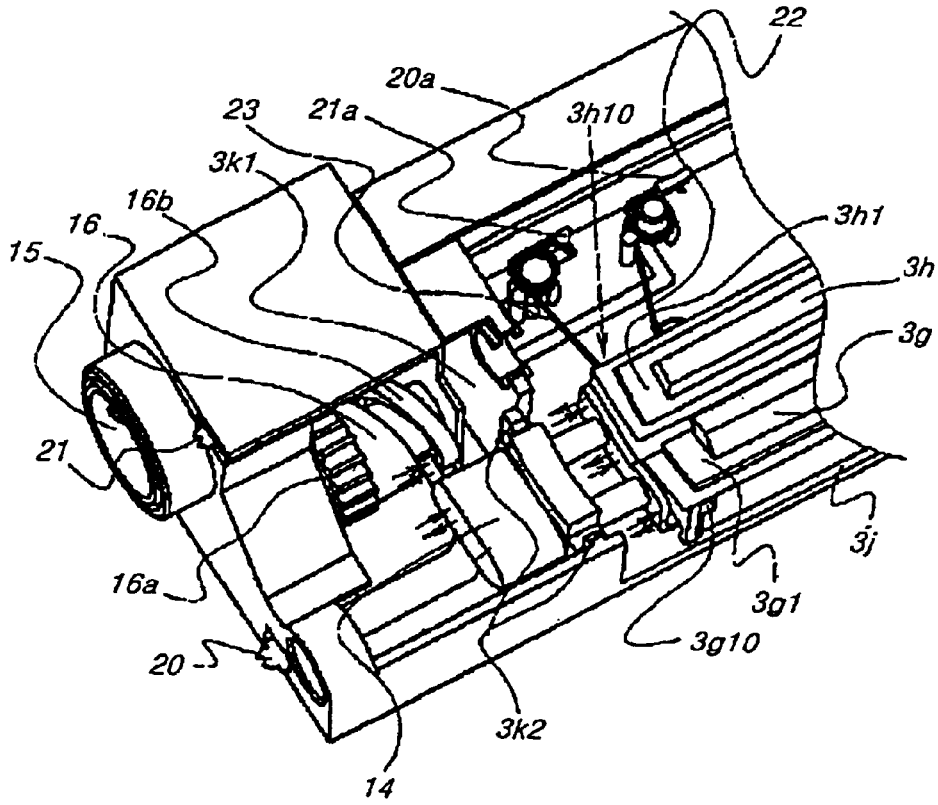
FIG. 9 is a perspective view showing a feeding contact member and the vicinity of the charging unit.

The image forming apparatus in this embodiment adapts a non-cleaner system. This non-cleaner system is described. FIG. 7 is a cross section showing the charging unit adapting a non-cleaner system; FIG. 8 is a perspective view showing the charging unit adapting the non-cleaner system; FIG. 9 is a perspective view showing a feeding contact member and the vicinity of the charging unit.

First, the summary of the non-cleaner system in the image forming apparatus of this embodiment is described with reference to FIG. 2. The remaining developing agent image on the photosensitive drum 2 after the transfer is carried to the developing section c upon passing through the charging section a and the exposing section b according to the subsequent rotation of the photosensitive drum, and is cleaned, or namely collected, concurrently with being developed by the developing apparatus.

Since the remaining developing agent image on the surface of the photosensitive drum 2 passes through the exposing section b, the exposing step is done over the remaining developing agent image, and because the amount of the remaining developing agent image is small, a large influence does not appear. The remaining developing agent image contains a normal polarity agent, a reverse polarity agent (reverse developing agent), and an agent having a small charging amount, and when the reverse developing agent and the agent having the small charging amount pass through the charging section a, the agents are adhered to the charging roller 3*a*, thereby rendering the charging roller 3*a* dirty more than the permissive amount and thereby inflicting charging defects.

In order to perform the cleaning concurrently done with development at the developing apparatus with respect to the remaining developing agent image on the photosensitive drum, it is necessary that the charging polarity of the remaining developing agent image on the photosensitive drum carried to the developing section c is the normal polarity and that the charging amount is of an amount that the electrostatic latent image on the photosensitive drum can be developed by the developing apparatus. The reverse developing agent and the developing agent of improper charging amounts cannot be collected and removed to the developing apparatus from the photosensitive drum, thereby causing defective images.

According to recent various needs of the user, by continuous printing operation or the like of the images at a high printing rate such as the photographic images, the remaining developing agent image of a large volume occurs at once, so that the above problem further becomes worse.

In this embodiment, a remaining developing agent charging amount controlling means serving as a charger to which a negative voltage applies, e.g., a brush member (hereinafter referred to as "charging controlling brush 3*h*") is arranged on an upstream side in the rotation direction of the photosensitive drum 2 with respect to the charging roller 3*a* and on a downstream side with respect to the transfer portion d to render the charging polarity of the remaining developing agent image uniformly at the negative polarity as the normal charging polarity of the developing agent. Furthermore, a remaining developing agent image unifying means, e.g., a brush member (hereinafter referred to as "unifying brush 3*g*") is arranged on an upstream side in the rotation direction with respect to the charging controlling brush 3*h* and on a downstream side with respect to the transfer portion d to unify the remaining developing agent image on the photosensitive drum 2. A positive voltage applies to the remaining developing agent image unifying means.

By using the remaining developing agent image unifying means, even where the remaining developing agent image on a pattern on the photosensitive drum carried from the transfer portion d to the remaining developing agent charging amount controlling means has a large amount of the developing agent, the developing agent is dispersed on the surface of the photosensitive drum and does not make any pattern. The developing agent therefore does not concentrate locally at any part of the remaining developing agent charging amount controlling means, so that normal polarity charging processing of the remaining developing agent image as a whole is done adequately by the remaining developing agent charging amount controlling means, thereby preventing the remaining developing agent image from clinging to the charging roller 3*a* effectively. In addition, this also prevents any ghost image of the remaining developing agent image pattern from occurring.

In this embodiment, the unifying brush 3*g* and the charging controlling brush 3*h* are brush shaped members having a proper conductivity, and are disposed so that the brush portion is in contact with the surface of the photosensitive drum. Those means move (or reciprocally move) in the longitudinal direction of the photosensitive drum by a drive source, not shown.

A mechanism of the charging unit is described. As shown in FIG. 7, the charging roller 3*a* is rotatively supported at a charging roller supporting portion 3*k*1 of a charging container 3*k* of the charging unit 3 constituting a part of the process cartridge as being pressed by a pushing spring 3*d* in a direction such that the charging roller 3*a* contacts to the photosensitive drum 2, and rotates as driven by the rotation of the photosensitive drum 2.

As shown in FIG. 8, a brush unit 3*j* is constituted by securing the unifying brush 3*g* and the charging controlling brush 3*h* to a brush supporting member 12. As shown in FIG. 9, the brush unit 3*j* is supported to a brush unit supporting portion 3*k*2 so as to be movable reciprocally with respect to the longitudinal direction of the photosensitive drum 2.

The reciprocal movement of the brush unit 3*j* is substantially the same as the charging roller cleaning unit 3*f*, and the rotational drive is transmitted from a body coupler, not shown, to a coupling 15 formed at the developing apparatus and further transmitted from a coupling gear portion 15*a* integrally formed to the coupling 15 via the cam gear 16*a* to the cam portion 16*b*. The cam portion 16*b* is arranged so that a reciprocal movement transmission arm 14 secured to an end of the brush supporting member 12 is located at the cam portion 16*b*, and by engaging the cam portion 16*b* with a protrusion 14*a* of the transmission arm 14 the rotational drive at the cam portion 16*b* is converted to reciprocal movement, thereby moving reciprocally the brush unit 3*j* in the longitudinal direction of the charging roller 3*a*. In this embodiment, the unit moves reciprocally with 5 mm stroke and a constant period in a range of about 0.5 to 2.5 seconds. It is to be noted that as shown in FIG. 6, the cam portion 16*b* may be urged by using a returning spring 31, but as shown in FIG. 8, a protrusion 14*a* may be made to slide where a groove or grooves are formed at the cam portion 16*b*.

By providing the movable mechanism as described above, the unifying brush 3*g* and the charging controlling brush 3*h* do not stably take a single position on the photosensitive drum, and therefore, even where overcharging portions or charging shortly portions exist due to resistance irregularity of the charging controlling brush 3*h*, the mechanism prevents the remaining developing agent image from melting and adhering to the surface of the photosensitive drum due to local overcharge of the remaining developing agent image and prevents the remaining developing agent image from clinging to the charging roller 3*a* due to shortage of charges or reduces such occurrences.

[Exposing Apparatus]

In this embodiment, as shown in FIG. 1, exposure to the photosensitive drum 2 is done using the laser exposing apparatus. That is, when an image signal sent from the apparatus body, laser beam L, modified corresponding to the signal, is scanned to perform exposure on the uniformly charged surface of the photosensitive drum 2. An electrostatic latent image is selectively formed corresponding to the image information on the surface of the photosensitive drum 2.

The laser exposing apparatus is constituted of, e.g., a solid laser device, not shown, a polygon mirror 51*a*, a convergence lens 51*b*, and a reflection mirror 51*c*. The solid laser device is controlled to be turned on and off as to emit and not to emit a beam with a prescribed timing from a light emitting signal generator, not shown, according to the inputted image signal. The laser beam L emitted from the solid laser device is converted to a substantially parallel beam flux by a collimator lens system, not shown, and is scanned by the polygon mirror 51*a* rotating at a high rate. The beam is focused in a spot shape on the photosensitive drum 2 via the convergence lens 51*b* and the reflection mirror 51*c*.

An exposure profile according to the image signal is thus obtained on the surface of the photosensitive drum 2 with exposure in the main scanning direction by the laser beam scanning and exposure in the sub-scanning direction by rotation of the photosensitive drum 2. That is, by radiation and non-radiation of the laser beam L, a bright portion potential at which the surface potential is dropped and a dark portion potential at which the surface potential is not dropped are formed. The electrostatic latent image is formed corresponding to the image information by contrast between the bright portion potential and the dark portion potential.

[Developing Means]

The developing apparatus 4 as the developing means is a two component contact developing apparatus (two-component magnetic brush developing apparatus) as shown in FIG. 2, and holds a carrier and a developing agent on a developing sleeve 4*a* as a developing agent carrier containing a magnet roller 4*b*. A limiting blade 4*c* is formed to the developing sleeve 4*a* with a prescribed gap, and according to the rotation of the developing sleeve 4*a* in the arrow direction, a developing agent of a thin layer is formed on the developing sleeve 4*a*.

The developing sleeve 4*a* is disposed, as shown in FIG. 4, to have a prescribed gap to the photosensitive drum 2 by rotatively fitting a spacer 4*k* to a journal portion 4*a*1 having a shorter diameter at the opposite ends, respectively. It is designed that the developing agent formed on the developing sleeve 4*a* during the developing operation is developed as being contacting to the photosensitive drum 2. The developing sleeve 4*a* is driven to rotate at a prescribed peripheral speed in the arrow direction in FIG. 2 as a counter direction to the rotation direction of the photosensitive drum 2 at the developing section.

The developing agent used in this embodiment is made of a negative charging developing agent having an average particle size of 6 microns and a magnetic carrier having an average particle size of 35 microns with a saturation magnetization of 205 emu/cm$^3$ as a magnetic carrier. A mixture of the negative charging developing agent and the carrier with a weight ratio of 6 to 94 is used as the developing agent.

The developing agent container 4*h* in which the developing agent is circulating is divided into two parts by a diaphragm 4*d* extending in the longitudinal direction except each end Stirring screws 4*e*A, 4*e*B are disposed astride the diaphragm 4*d*. The developing agent supplied from the developing agent supplying container fills off at a rear side of the stirring screw 4*e*B as shown in FIG. 4, is stirred as fed to the front side in the longitudinal direction, and passes through a portion at which no diaphragm 4*d* on a front side end exists. The developing agent is further fed to the rear side in the longitudinal direction with the stirring screw 4*e*A, passes through a portion at which no diaphragm 4*d* on a rear side exists, and is stirred as fed with the stirring screw 4eB to repeat this circulation.

The developing step in which the electrostatic latent image formed on the photosensitive drum 2 is visualized using the developing apparatus 4 in the two-component magnetic brush method and a circulation system of the developing agent are described. According to the rotation of the developing sleeve 4*a*, the developing agent in the developing apparatus is conveyed upon being sucked up to the surface of the developing sleeve 4*a* at a sucking up pole of the magnet roller 4*b*. Midway during its conveyance, the developing agent is subject to a limitation on its thickness by the limiting blade 4*c* disposed perpendicularly to the developing sleeve 4*a*, thereby forming a thin layer of developing agent on the developing sleeve 4*a*. When the thin layer of developing agent is conveyed to the developing pole corresponding to the developing portion, a standing-upright phenomenon, like ears, is formed by magnetic force. The electrophotographic latent image on a surface of the photosensitive drum 2 is developed as a developing agent image with the developing agent in the developing agent thus formed standing upright in an ear shape. In this embodiment, the electrophotographic latent image is reverse developed.

The thin layer developing agent on the developing sleeve 4*a* passing the developing section subsequently enters in the developing container according to the rotation of the developing sleeve 4*a*, and is returned to a developing agent reservoir in the developing container upon separating from the surface of the developing agent 4*a* by resilient magnetic field of the conveyance pole. A direct current (DC) voltage and an alternative current (AC) voltage are fed to the developing agent 4*a* from the power source, not shown. In this embodiment, a DC voltage of −500 V and an AC voltage having frequency 2000 Hz and peak to peak voltage of 1500 V are applied, thereby selectively developing the exposed portions on the photosensitive drum 2.

Generally, with the two-component developing method, the developing rate increases by application of the alternative current voltage to render the images of a high quality, but this raises the risk that blurring tends to occur easily. Therefore, in general, prevention of blurring is realized by providing a potential difference between the DC voltage applied to the developing sleeve 4*a* and the surface potential of the photosensitive drum 2. More specifically, a bias voltage is applied which is at a potential between the potential of the exposure portion of the photosensitive drum 2 and the potential of the non-exposure portion.

If the developing agent is consumed by developing operation, the developing agent concentration in the developing agent is reduced. In this embodiment, a sensor 4*g* is arranged at a position near the outer periphery of the stirring screw 4eB to detect the developing agent concentration. If the sensor 4*g* detects that the developing agent concentration in the developing agent is reduced more than a prescribed concentration level, an instruction to supply the developing agent from the developing agent supplying container into the developing apparatus 4 is made. According to this developing agent supply operation, the developing agent concentration in the developing agent is managed to be always kept at a prescribed level.

[Developing Agent Supplying Container]

The developing agent supplying containers 5Y, 5M, 5C, 5K are arranged parallel over the process cartridges 1Y, 1M, 1C, 1K, and as described above, are attached from a front side of the apparatus body 100.

As shown in ?FIG. 2, a stirring plate 5*b* secured to a stirring shaft 5*c* and a screw 5*a* are disposed in the developing agent supplying container, and a drain opening 5*f* for draining the developing agent is formed at the bottom of the container. The screw 5*a* and the stirring shaft 5*c* are rotatively supported as shown in FIG. 5, and a drive coupling (female) 5*e* is provided at an endmost point on one side of the screw 5*a*. The drive coupling (female) 5*e* receives drive transmission from a drive transmission (male) 62*b* and is rotatively driven. The contour portion of the screw 5*a* is in a spiral rib shape and makes reverse the screwing direction of the spiral rib at the drain opening 5*f* as a center.

The screw rotates in a prescribed rotation direction according to the rotation of the drive coupling (male) 62*b*. The developing agent is conveyed toward the drain opening 5*f*, and is dropped off freely through the opening of the drain opening 5*f* to supply the developing agent in the process cartridge. The front end in the rotation radius direction of the stirring plate is slanted to contact with a certain angle to a wall of the developing agent supplying container when sliding on the wall. More specifically, by twisting and slanting the front end side of the stirring plate, a conveyance force toward the shaft direction is produced, thereby feeding the developing agent in the longitudinal direction.

It is to be noted that the developing agent supplying container of the embodiment is not limited to the two component developing method but can supply to a process cartridge or developing cartridge using a single component developing method, and the powder contained in the developing agent supplying container is not limited to the developing agent but also can be a so-called developing agent in which the developing agent and a magnetic carrier are mixed.

[Transfer Means]

The intermediate transfer unit 54 as a transfer means is to secondarily transfer the plural developing agent images overlapped sequentially from the photosensitive drums 2 as a primary transfer, on the recording medium 52 at once. The intermediate transfer unit 54 has an intermediate transfer belt 54*a* running in the arrow direction, which runs at substantially the same peripheral speed of the photosensitive drum 2 in the clockwise direction of the arrow. The intermediate transfer belt 54*a* is an endless belt having a peripheral length of about 940 mm, and is suspended by three rollers, a drive roller 54*b*, a secondary transfer facing roller 54*g*, and a driven roller 54*c*.

The primary transfer rollers 54fY, 54fM, 54fC, 54fK are disposed rotatably at opposing positions to the photosensitive drums 2, respectively in contact with the intermediate transfer belt 54*a* and are pressed toward the center direction of each photosensitive drum 2. The primary transfer rollers 54fY, 54fM, 54fC, 54fK are fed with electricity from a high voltage power supply, not shown, and the developing agent on each photosensitive drum 2 is sequentially, primarily transferred on the top surface of the intermediate transfer belt 54*a* upon charging the belt to the opposite polarity from the developing agent from the back side of the intermediate transfer belt 54*a*.

The secondary transfer roller 54*d* serving as a transfer member comes in contact with the intermediate transfer belt 54*a* at a position facing to the secondary transfer facing roller 54*g* at the secondary transfer section. The secondary transfer roller 54*d* is pivotally movable in up and down direction in the drawing and rotates. A bias is concurrently applied to the intermediate transfer belt 54*a* at that time, and the developing agent image on the intermediate transfer belt 54*a* is transferred onto the recording medium 52. The intermediate transfer belt 54*a* and the secondary transfer roller 54*d* are respectively driven. When the recording medium 52 enters into the secondary transfer portion, a prescribed bias is applied to the secondary transfer roller 54*d*, thereby secondarily transferring the developing agent image on the intermediate transfer belt 54*a* to the recording medium 52. At that time, the recording medium 52 in a state sandwiched by the belt and the roller is conveyed at a prescribed speed in the left direction in the drawing concurrently subjecting to the transfer step, and is further conveyed toward the fixing device 56 as of the subsequent step.

A cleaning unit 55 capable of contacting and separating from the surface of the intermediate transfer belt 54*a* is arranged at a prescribed position of the intermediate transfer belt 54*a* as a most downstream side of the transfer step, and removes the remaining developing agent image remaining after the secondary transfer step. A cleaning blade 55*a* is disposed in the cleaning unit 55 to remove the remaining developing agent image. The cleaning unit 55 is attached in a pivotally movable manner around a rotary center, not shown, and the cleaning blade 55*a* is in pressured contact with the intermediate transfer belt 54*a* in a strongly pressing direction. The remaining developing agent image taken in the cleaning unit 55 is conveyed to and stored in a waste developing agent tank, not shown, by a feeding screw.

As the intermediate transfer belt 54*a*, usable is a polyimide resin. As other materials, not limited to the polyimide resin, favorably used are plastic materials such as polycarbonate resin, polyethylene terephthalate resin, polyvinylidene fluoride resin, polyethylene naphthalate resin, polyetherether ketone resin, polyether sulfone resin, and polyurethane resin, and rubbers of flouride system and slicone system.

[Fixing Section]

The developing agent image formed on the photosensitive drum 2 by the developing means is transferred onto the transfer material 52 via the intermediate transfer belt 54*a*. The fixing device 56 fixes the developing agent image transferred on the recording medium 52 using heat to the recording medium 52.

As shown in FIG. 1, the fixing device 56 includes a fixing roller 56*a* for applying heat to the recording medium 62, and a pressing roller 56*b* for pressing the recording medium 52 to contact with the fixing roller 56*a*, and each roller is a hollow roller. Each has a heater, not shown, inside. The rollers convey the recording medium 52 at the same time upon rotatively driven.

That is, while the recording medium 52 holding the developing agent image is conveyed with the fixing roller 56*a* and the pressing roller 56*b*, the developing agent image is fixed to the recording medium 52 in application of heat and pressure. The recording medium 52 after the fixing step is delivered by delivery rollers 53*h*, 53*j* and stacked on a delivery tray 57 on the apparatus body 100.

[Attachment of Process Cartridge and Developing Agent Supplying Container]

Next, attachment steps of the process cartridge and the developing agent supplying container are described by referring to FIG. 2, FIG. 3, and FIG. 4. As shown in FIG. 3, an openable front door 58 is disposed on a front side of the apparatus body 100, and when the front door 58 is pulled to open, an opening for inserting the process cartridges 1Y to 1K and the developing agent supplying containers 5Y to 5K is exposed. A core setting plate 59 that is rotatably supported, is disposed at the opening for inserting the process cartridge, and in a case where the process cartridge is inserted or pulled out, this operation is to be done after releasing the core setting plate 59.

As shown in FIG. 2, in the apparatus body 100, a guide rail 60 for guiding the attachment of the process cartridge, and a guide rail 61 for guiding the attachment of the developing agent supplying container 5 are secured. The attachment direction of the process cartridge and the developing agent supplying container 5 is a direction parallel to the axial direction of the photosensitive drum 2, and the guide rails 60, 61 are disposed in substantially the same direction. The process cartridge and the developing agent supplying container 5 are inserted at once sliding from the front side to the rear side in the apparatus body 100 along the guide rails 60, 61.

As shown in FIG. 4, when the process cartridge is inserted to the rearmost portion, a core setting shaft 66 of the apparatus body is inserted into a center hole 2*f* of the drum flange 2*b*, thereby setting the rotational center position on a rear side of the photosensitive drum 2 with respect to the apparatus body. At the same time, the drive transmission portion 2*g* formed at the drum flange 2*b* and the drive coupling (male) 62*a* are coupled to allow the photosensitive drum 2 to be rotatably driven. The drive transmission portion 2*g* used in this invention is in a twisted triangular prism shape, to which the drive is transmitted by application of a drive force from the apparatus body, and generates a force pulling the photosensitive drum 2 rearward.

A supporting pin 63 for positioning the process cartridge is disposed at a rear side plate 65, and the supporting pin 63 is inserted in a frame of the process cartridge, thereby securing the position of the frame of the process cartridge.

A rotatable core setting plate 59 is disposed on a front side of the apparatus body 100, and with respect to the core setting plate 59, the bearing casing 2*c* of the process cartridge is fixedly supported. According to the series of the insertion operations, the photosensitive drum 2 and the process cartridge are positioned with respect to the apparatus body 100.

On the other hand, the developing agent supplying container 5 is secured to the supporting pin 63 projecting from the rear side plate 65 when inserted up to the rearmost portion. At the same time, the drive coupling (female) 5*e* and the drive coupling (male) 62*b* are coupled to each other, thereby allowing rotational driving of the screw 5*a* and the stirring shaft 5*c*.

[Electric Contact Member]

Figure 10:
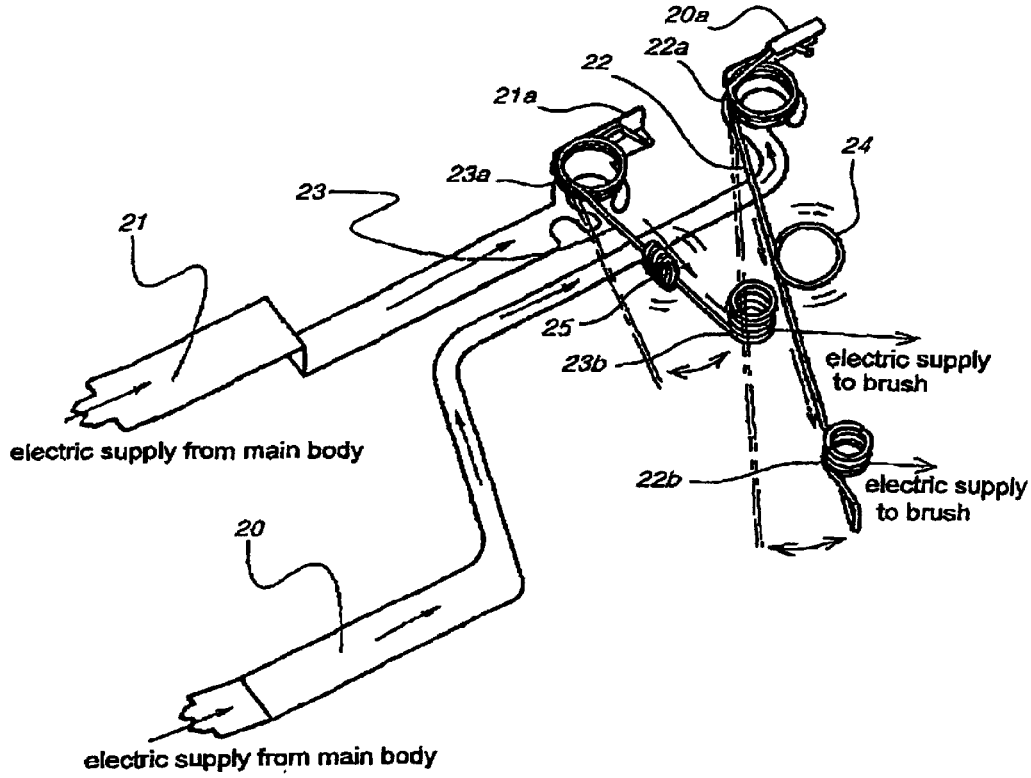
FIG. 10 is a perspective view showing a feeding metal plate for brush feeding and a brush feeding contact member.

Next, an electrically feeding contact member as an electric contact member in the charging unit having the above structure is described using FIG. 7, FIG. 8, FIG. 9, and FIG. 10. FIG. 10 is a perspective view showing a feeding metal plate for brush feeding and a brush feeding contact member.

As shown in FIG. 7 and FIG. 8, as described above, the unifying brush 3*g* as an example of the remaining developing agent image unifying means as a charger, and the charging amount controlling brush 3*h* as an example of the remaining developing agent image charging amount controlling means as a charger are secured to the brush supporting member 12 in the charging unit 3 constituting a part of the process cartridge, and are disposed to be reciprocally movable as the brush unit 3*j*. The function of the non-cleaner system can be done by feeding stably from the apparatus body to the unifying brush 3*g* and by reciprocally moving the charging controlling brush 3*h* of the brush unit 3*j*.

As shown in FIG. 7 and FIG. 9, feeding is performed to the unifying brush 3*g* from the apparatus body via a first feeding plate 20, and a first feeding contact member 22 as a first electrical contact member. In substantially the same way, feeding is performed the charging controlling brush 3*h* via a second feeding plate 21, and a second feeding contact member 23 as a second electrical contact member. The first feeding plate 20 secured to the charging container 3*k* is fed by a power source as a voltage applying means formed at the apparatus body, and is connected to the first feeding contact member 22 at a contact point portion 20*a* (see FIG. 9). The first feeding contact member 22 is connected to a contact point portion 3*g*10 (see FIG. 7), and feeding is made from the back surface of a metal plate base 3*g*1 to the unifying brush 3*g*. In substantially the same way, the second feeding plate 21 secured to the charging container 3*k* is fed by a power source of the apparatus body, and is connected to the second feeding contact member 23 at a contact portion 21*a* (see FIG. 9). The second feeding contact member 23 is connected to a contact portion 3*h*10 (see FIG. 7), and feeding is made from the back surface of a metal plate base 3*h*1 to the charging controlling brush 3*h*.

FIG. 10 illustrates only the first feeding plate 20, the second feeding plate 21, the first feeding contact member 22 extending linearly, and the second feeding contact member 23 extending linearly. The first and second feeding contact members 22, 23 are in a linear shape, and therefore, it is advantageous because no large load is exerted mechanically when a voltage is supplied to the brushes 3*g*, 3*h*. Although a positive voltage is applied to the first feeding contact member 22 whereas a negative voltage is applied to the second feeding contact member 23, the distance between the first feeding contact member 22 and the second feeding contact member 23 in the left and right direction in FIG. 7 (or a direction perpendicular to the longitudinal direction of the photosensitive drum) can be maintained at a distance not electrically leaking between the members because the members are in the linear shape, so that a further compact space is possible.

As shown in FIG. 10, the opposite ends of the first feeding contact member 22 are formed at a torsion spring 22*a* as a fixing portion and a coil spring 22*b* as a portion moving reciprocally. In substantially the same way, the opposite ends of the second feeding contact member 23 are formed at a torsion spring 23*a* as a fixing portion and a coil spring 23*b* as a portion moving reciprocally. With this structure, the feeding contact members 22, 23 can be transformed according to the brush unit 3*j* reciprocally moving, so that feeding can be made always.

However, where the brush unit 3*j* moves reciprocally, the feeding contact members 22, 23 receive the load repeatedly. Particularly, because the distance between the opposite ends of the feeding contact members 22, 23 may vary in association with the reciprocal movement of the brush unit 3*j*, the torsion spring and the coil spring may not correspond to the change in terms of the mechanism, so that the load exerted to the members may become so large. Where the members are used for a long period of time, the feeding contact members 22, 23 may be broken or dropped, and charging defects or collection defects may occur due to feeding shortage to the unifying brush 3*g* and the charging controlling brush 3*h*.

To solve this problem, as shown in FIG. 10, in this embodiment, a ring shaped elastic torsion spring 24 as a buffer portion, which is an example of a buffering mechanism, is formed between the torsion spring 22*a* at the securing portion on the power source side and the coil spring 22*b* at the moving portion on the charger side in the first feeding contact member 22. In the second feeding contact member 23, a ring shaped elastic torsion spring 25 as a buffer portion, which is an example of a buffering mechanism, is formed between the torsion spring 23*a* at the securing portion on the power source side and the coil spring 23*b* at the moving portion on the charger side.

It is to be noted that the buffering mechanism is not limited to the torsion spring and the coil spring. A member having an elastic shape with elasticity to the distance between the opposite ends of the feeding contact members 22, 23 may be used. Accordingly, for example, a bending portion in a mountain shape, a wave shape, and a saw shape may be formed at an intermediate portion of the feeding contact members 22, 23, or a large curving between the opposite ends may take advantages of the invention though with a simpler structure.

As described above, the electric contact member, the process cartridge, and the image forming apparatus according to the invention can buffer repetitive loads exerted to the electric contact member with a very simple structure but without inviting an increase of the number of parts, thereby preventing the electric contact member from receiving damage or dropping off. Therefore, certain feeding can be performed to the remaining developing agent charging amount controlling means and the remaining developing agent image unifying means, so that charging defects or collection defects of the remaining developing agent can be prevented.

What is claimed is:

1. An electric contact member applying a voltage from a voltage applying means to a charger reciprocally moving in a longitudinal direction of an image carrier, comprising:

a securing portion electrically connected to a side of the voltage applying means;

a reciprocally movable moving portion connected electrically to a side of the charger; and a buffer portion formed between said securing portion and said moving portion.

2. The electric contact member according to claim 1, wherein said buffer portion has an elasticity.

3. The electric contact member according to claim 1, wherein said buffer portion is in a ring shape.

4. The electric contact member according to claim 1, wherein said buffer portion has a torsion spring portion.

5. The electric contact member according to claim 1, wherein said buffer portion has a coil spring portion.

6. The electric contact member according to claim 1, wherein at least one of said securing portion and said moving portion has a torsion spring portion.

7. The electric contact member according to claim 1, wherein at least one of said securing portion and said moving portion has a coil spring portion.

8. The electric contact member according to claim 1, 2, 3, 4, 5, 6, or 7, wherein said electric contact member is in a linear shape.

9. A process cartridge detachably attachable to a body of an image forming apparatus, comprising:

an image carrier;

a charger reciprocally moving in a longitudinal direction of said image carrier; and an electric contact member configured and positioned to apply a voltage from a voltage applying means to said charger, said electric contact member comprising:

a securing portion electrically connected to a side of the voltage applying means;

a reciprocally movable moving portion connected electrically to a side of said charger; and a buffer portion formed between said securing portion and said moving portion.

10. The process cartridge according to claim 9, wherein said charger charges a developing agent remaining on said image carrier.

11. The process cartridge according to claim 10, wherein said charger is placed on a downstream side of a transfer position at which a developing agent image is transferred from said image carrier to a transfer member and on an upstream side of a charging means for charging said image carrier, in the moving direction of said image carrier.

12. The process cartridge according to claim 9, wherein said charger moves reciprocally in contact with said image carrier.

13. The process cartridge according to claim 12, wherein said charger has a brush member in contact with said image carrier.

14. The process cartridge according to claim 9, wherein said buffer portion has an elasticity.

15. The process cartridge according to claim 9, wherein said buffer portion is in a ring shape.

16. The process cartridge according to claim 9, wherein said buffer portion has a torsion spring portion.

17. The process cartridge according to claim 9, wherein said buffer portion has a coil spring portion.

18. The process cartridge according to claim 9, wherein at least one of said securing portion and said moving portion has a torsion spring portion.

19. The process cartridge according to claim 9, wherein at least one of said securing portion and said moving portion has a coil spring portion.

20. The process cartridge according to claim 11, wherein said process cartridge has a developing means for forming the developing agent image on said image carrier, and wherein the developing means can collect a remaining developing agent on said image carrier.

21. The process cartridge according to claim 9, 10, 11, 12, 13, 14, 15, 16, 17, 18, 19, or 20, wherein said electric contact member is in a linear shape.

22. An image forming apparatus comprising:

an image carrier;

a charger reciprocally moving in a longitudinal direction of said image carrier; and an electric contact member configured and positioned to apply a voltage from a voltage applying means to said charger, said electric contact member comprising:

a securing portion electrically connected to a side of the voltage applying means;

a reciprocally movable moving portion connected electrically to a side of said charger; and a buffer portion formed between said securing portion and said moving portion.

23. The image forming apparatus according to claim 22, wherein said charger is placed on a downstream side of a transfer position at which a developing agent image is transferred from said image carrier to a transfer member and on an upstream side of a charging means for charging said image carrier, in the moving direction of said image carrier and charges a developing agent remaining on said image carrier, wherein said apparatus has a developing means for forming the developing agent image on said image carrier, and wherein the developing means can collect a remaining developing agent on said image carrier.

24. The image forming apparatus according to claim 22, wherein said buffer portion has an elasticity.

25. The image forming apparatus according to claim 22, wherein said buffer portion is in a ring shape.

26. The image forming apparatus according to claim 22, wherein said buffer portion has a torsion spring portion.

27. The image forming apparatus according to claim 22, wherein said buffer portion has a coil spring portion.

28. The image forming apparatus according to claim 22, 23, 24, 25, 26, or 27, wherein said electric contact member is in a linear shape.

* * * * *

UNITED STATES PATENT AND TRADEMARK OFFICE

CERTIFICATE OF CORRECTION

PATENT NO. : 6,954,600 B2
APPLICATION NO. : 10/671520
DATED : October 11, 2005
INVENTOR(S) : Akiyoshi Fujita et al.

It is certified that error appears in the above-identified patent and that said Letters Patent is hereby corrected as shown below:

ON PAGE 2 OF THE COVER PAGE AT (56) References Cited, U.S. PATENT DOCUMENTS:

| | | |
|---|---|---|
| "6,577,831 B1 | 6/2003 | Numagami et al." should read |
| --6,577,831 B1 | 6/2003 | Kojima et al.--. |

COLUMN 1:
Line 28, "an" should read --a--.
Line 58, "so-called-the" should read --the so-called--.

COLUMN 2:
Line 8, "blush" should read --brush--.
Line 44, "may" should read --may become--.
Line 47, "It" should read --¶It--.

COLUMN 3:
Line 11, "still" should read --still a--.

COLUMN 4:
Line 32, "stop" should read --stops--.

COLUMN 5:
Line 4, "SnO2" should read --$SnO_2$--.

COLUMN 7:
Line 39, "arm 14" should read --arm14,--.

COLUMN 8:
Line 59, "end" should read --end.--.
Line 61, "fills" should read --falls--.

COLUMN 9:
Line 66, "?FIG. 2," should read --FIG. 2,--.

COLUMN 10:
Line 9, "makes reverse" should read --reverses--.

UNITED STATES PATENT AND TRADEMARK OFFICE

CERTIFICATE OF CORRECTION

PATENT NO. : 6,954,600 B2
APPLICATION NO. : 10/671520
DATED : October 11, 2005
INVENTOR(S) : Akiyoshi Fujita, et al.

It is certified that error appears in the above-identified patent and that said Letters Patent is hereby corrected as shown below:

COLUMN 11:
Line 32, "slicone" should read --silicone--.
Line 41, "medium 62," should read --medium 52,--.

COLUMN 12:
Line 66, "performed" should read --performed to--.

Signed and Sealed this

Twenty-second Day of August, 2006

JON W. DUDAS
*Director of the United States Patent and Trademark Office*